United States Patent [19]

Schafer

[11] 4,266,207

[45] May 5, 1981

[54] COAXIAL CABLE BAND-PASS FILTER

[75] Inventor: Robert H. Schafer, Perkasie, Pa.

[73] Assignee: UTI Corporation, Collegeville, Pa.

[21] Appl. No.: 92,167

[22] Filed: Nov. 7, 1979

[51] Int. Cl.[3] ..... H01P 1/20; H01P 3/06; H01P 11/00

[52] U.S. Cl. ..... 333/206; 29/600; 333/243; 333/245

[58] Field of Search ..... 333/202, 33, 206, 207, 333/222, 223, 236, 245, 243; 29/600, 601; 174/28, 70 R, 70 S, 75 C, 88 C

[56] References Cited

U.S. PATENT DOCUMENTS

| | | | |
|---|---|---|---|
| 2,438,913 | 4/1948 | Hansen | 333/33 X |
| 3,452,429 | 7/1969 | Liebscher | 333/243 X |
| 4,161,704 | 7/1979 | Schafer | 333/33 |

*Primary Examiner*—Marvin L. Nussbaum

*Attorney, Agent, or Firm*—Seidel, Gonda, Goldhammer & Panitch

[57] ABSTRACT

The band-pass filter coupling element of a coaxial cable is in the form of a laminent of dielectric material having a conductive layer on opposite faces. Each end face is metallurgically joined to an end face of a center conductor. A sleeve of dielectric material surrounds each center conductor. A seamless tube of dielectric material surrounds the filter elements and the dielectric sleeves. A monolithic jacket of electrically conductive metal surrounds said seamless tube.

5 Claims, 2 Drawing Figures

COAXIAL CABLE BAND-PASS FILTER

BACKGROUND

The present invention is an improvement over the coaxial cable disclosed in U.S. Pat. No. 4,161,704 and other prior art band-pass filters which rely on a compression fit. The prior art band-pass filters for use in coaxial cable are difficult to assemble in order to obtain repetitive results. In the present invention, the filters are constructed in a manner which is easy to manufacture, provides more uniform performance, and has other advantages as will be made clear hereinafter.

SUMMARY OF THE INVENTION

The present invention is directed to a coaxial cable having at least one band-pass filter coupling element in the form of a laminent of dielectric material having a conductive layer on opposite faces. There is provided at least two center conductors. Each center conductor has one end face metallurgically joined to a separate one of the conductive layers. The dielectric material is substantially thicker than the thickness of each of the conductive layers. A sleeve of dielectric material surrounds each center conductor.

A seamless tube of dielectric material surrounds and contacts the outer periphery of said sleeve and laminent. A monolithic jacket of electrically conductive material surrounds said seamless tube and exerts radially inward compressive force on the entire circumference of said seamless tube to eliminate any air gap therebetween.

It is an object of the present invention to improve the construction and method of assembly of band-pass filters for use in coaxial cables so as to increase and provide more uniform performance while at the same time increasing the ease with which the filter may be assembled.

Other objects will appear hereinafter.

For the purpose of illustrating the invention, there is shown in the drawings a form which is presently preferred; it being understood, however, that this invention is not limited to the precise arrangements and instrumentalities shown.

DETAILED DESCRIPTION

Figure 1:
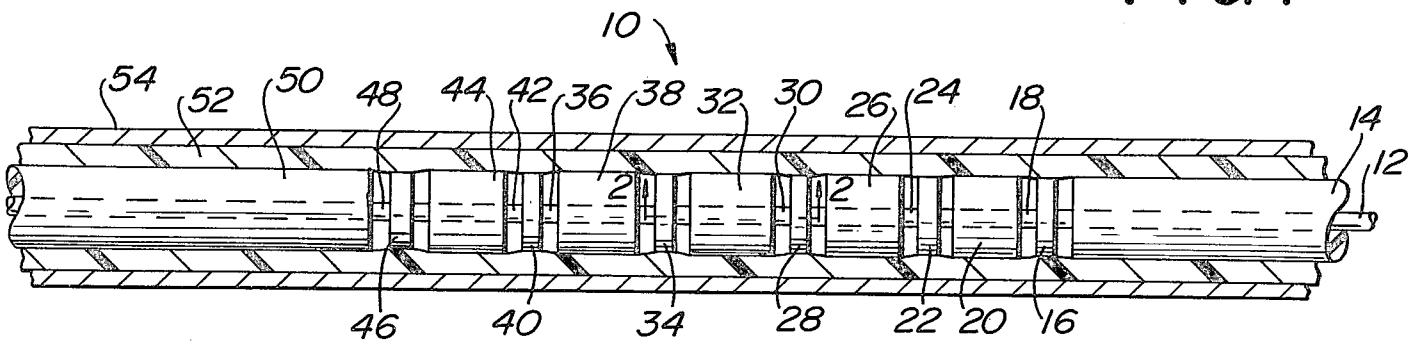
FIG. 1 is a longitudinal sectional view of a coaxial cable in accordance with the present invention.

Referring to the drawing in detail, where like numerals indicate like elements, there is shown in FIG. 1 a coaxial cable having a 5 stage band-pass filter designated generally as 10. The device 10 includes a plurality of center conductors. Center conductor 12 is surrounded by a dielectric sleeve 14 and has one end face metallurgically bonded to a filter coupling element 16. The opposite face of the filter coupling element 16 is metallurgically bonded to one end of a resonant conductor 18. The resonant conductor 18 is surrounded by a sleeve 20 of dielectric material. The other end of resonant conductor 18 is metallurgically bonded to one face of filter coupling element 22. The opposite face of filter coupling element 22 is metallurgically bonded to one end of resonant conductor 24 which is surrounded by a sleeve 26 of dielectric material.

The opposite end of resonant conductor 24 is metallurgically bonded to one face of a filter coupling element 28. The opposite face of filter coupling element 28 is metallurgically bonded to one end of resonant conductor 30. Resonant conductor 30 is surrounded by a sleeve 32 of dielectric material.

The other end of resonant conductor 30 is metallurgically bonded to one face of a filter coupling element 34. The other face of filter coupling element 34 is metallurgically bonded to one end of a resonant conductor 36. The resonant conductor 36 is surrounded by a sleeve 38 of dielectric material.

The other end of resonant conductor 36 is metallurgically bonded to one face of a filter coupling element 40. The opposite face of filter coupling element 40 is metallurgically bonded to one end of a resonant resonant conductor 42. Resonant conductor 42 is surrounded by a sleeve 44 of dielectric material.

The other end of resonant conductor 42 is metallurgically bonded to one face of a filter coupling element 46. The opposite face of filter coupling element 46 is metallurgically bonded to one end of a conductor 48. A sleeve 50 of dielectric material surrounds the conductor 48.

The center conductors 12, and 48 as well as resonant conductors 18, 24, 30, 36 and 42 are coaxial and are preferably made from a copper alloy having higher tensile strength than copper such as a commercial product sold under the trademark TENSILFLEX. The sleeves 14, 20, 26, 32, 38, 44 and 50 are preferably extruded onto the conductor so as to be fixedly secured thereto. Each of such sleeves are made from the identical dielectric materials such as a material sold commercially under the trademark TEFLON.

A seamless tube 52 of dielectric material surrounds each of the sleeves 14, 20, 26, 32, 38, 44 and 50. Tube 52 is preferably made from the same dielectric material as said sleeves. A jacket 54 surrounds the tube 52. Jacket 54 is a monolithic jacket of electrically conductive material such as copper having a radial thickness of about 0.008 inches. Where greater strength is needed, the jacket 54 may be made of stainless steel with a layer of copper on its inner periphery. The jacket 54 is preferably applied in the manner disclosed in my above mentioned U.S. Pat. No. 4,161,704 so that the jacket exerts a radially inward compressive force on the entire circumference of the seamless tube 52 to eliminate any air gap therebetween.

Figure 2:
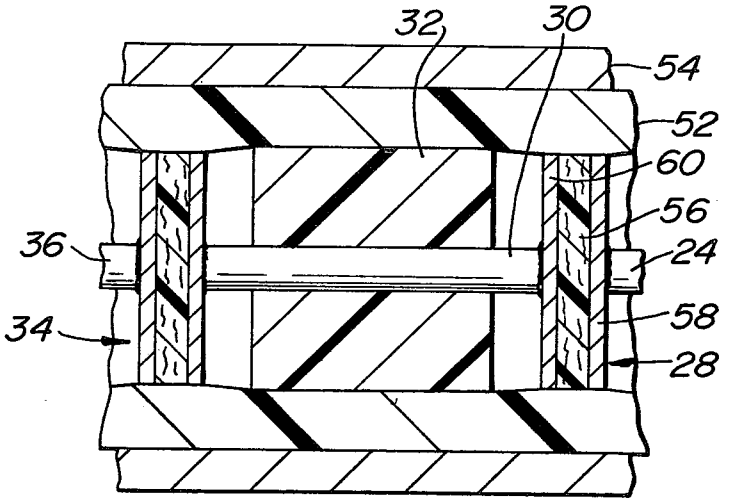
FIG. 2 is a sectional view taken along the line 2—2 in FIG. 1 but on an enlarged scale.

Each of the filter coupling elements described above is constructed in the same manner except for thickness and diameter of the components thereof. Hence, only filter coupling element 28 will be described in detail. Refering to FIG. 2, the filter coupling element 28 is a laminent with a central dielectric layer 56 clad on one surface with a conductive layer 58 and clad on its opposite surface with a conductive layer 60. The dielectric layer 56 may be one of a wide variety of dielectric material such as a material sold under the trademark TEFLON and reinforced with glass cloth. The conductive layers 58 and 60 are copper clad onto the opposite faces thereby avoiding the use of adhesives which create an energy loss. The layers 58, 60 have a thickness of about 0.0028 inches while the dielectric layer 56 has a thickness between 0.0053 and 0.062 inches depending on the amount of coupling desired. The laminent from which the filter coupling element 28 is made is sold commercially by a number of companies for an entirely different purpose such as MMM which sells a copper clad strip line laminent and RT/Duroid which sells a glass microfiber reinforced PTFE laminent material. Such materials are sold in the form of sheets and are used for microstrip circuit applications.

Each of the center conductors described above is metallurgically bonded to at least one face of a filter coupling element such as layer 58 or 60. Metallurgical bonds include soldering, brasing, and welding. Attempts to attain a bond by use of conductive epoxy were not satisfactory. As shown more clearly in FIG. 2, there is a small air gap having a width of about 0.05 inches between an end face on one of the sleeves and a juxtapposed face on one of the filter coupling elements. The air gaps result from the need for space to attain the metallurgical bonds.

While six filter coupling elements are illustrated in FIG. 1, a greater or lesser number may be provided as desired. The larger the number of filter coupling elements, the larger the minimum straight length is required for the cable 10. For example, the cable 10 requires a minimum of 4.6 inches of straight length so as to accomodate the filters and center conductors as illustrated in FIG. 1. Such embodiment has the following features. The end filter coupling elements 16 and 46 have a thickness of about 0.0053 inches with a diameter of 0.0074 inches; the filter coupling elements 22 and 40 have a thickness of about 0.015 inches and a diameter of about 0.065 inches; and the filter coupling elements 28 and 34 have a thickness of about 0.02 inches and diameter of about 0.063 inches. The jacket 54 had an outer diameter of 0.141 ±0.002 inches.

In the operative embodiment described above, the following electrical characteristics were present. The passband VSWR at 4.1 to 4.5 GHz was 1.7:1 max. The passband insertion loss at 4.1 to 4.5 GHz was 1.5 dB max. The coaxial cable had a 3 dB rejection at 4.01 GHz and 4.57 GHz; 10 dB rejection at 3.97 GHz and 4.62 GHz; and 50 dB minimum at DC to 3.60 GHz and 5.30 to 7.45 GHz.

In another operative embodiment of the present invention wherein the minimum straight length required to integrate the filter in a cable assembly was 2.2 inches, the passband VSWR at 8.2 to 9.0 GHz was 1.8:1 max. The passband insertion loss at 8.2 to 9.0 GHz was 1.5 dB max. The cable had a 3 dB rejection at 8.02 GHz and 9.14 GHz; a 10 dB rejection at 7.94 GHz and 9.24 GHz; and 50 dB rejection at DC to 7.20 GHz and 10.60 to 14.9 GHz.

Another operative environment of the present invention wherein the minimum straight length required to integrate the filter into a cable assembly was 4.2 inches, had the following characteristics. The passband VSWR at 3.9 to 4.7 GHz was 1.7:1 max. The passband insertion loss at 3.9 to 4.7 GHz was 1.5 dB max; a 3 dB rejection at 3.65 GHz and 4.76 GHz; 19 dB rejection at 3.57 GHz and 4.96 GHz; and 30 dB rejection at DC to 3.35 GHz and 5.50 to 6.90 GHz.

The present invention facilitates repeat characteristics which vary not more than 5%. The construction disclosed herein facilitates making filters which are small in length and diameter while at the same time are capable of being tuned by way of commercially available equipment.

The present invention may be embodied in other specific forms without departing from the spirit or essential attributes thereof and, accordingly, reference should be made to the appended claims, rather than to the foregoing specification, as indicating the scope of the invention.

I claim:

1. A coaxial cable comprising at least two center conductors aligned with one another, a sleeve of dielectric material around each center conductor, at least one filter coupling element in the form of a laminent of dielectric material having a conductive layer on opposite faces, each of said center conductors have one end face metallurgically joined to a separate one of said conductive layers, said laminent dielectric material being substantially thicker than the thickness of each one of said conductive layers, a seamless tube of dielectric material around and contacting the outer periphery of said sleeves and laminent, and a monolithic jacket of electrically conductive material surrounding said seamless tube, said jacket exerting radially inwardly compressive forces on the entire circumference of said seamless tube to eliminate any air gap therebetween.

2. A coaxial cable in accordance with claim 1 wherein there are a plurality of said filter coupling elements each connected to the next adjacent coupling element by one of said center conductors.

3. A coaxial cable in accordance with claim 1 wherein said laminent dielectric material is reinforced with glass or fabric and the conductive layers being clad on said laminent dielectric material.

4. A coaxial cable in accordance with claim 1 wherein said laminent dielectric material has a thickness which is between 2 and 20 times the thickness of the conductive layers on opposite faces thereof.

5. A method of making a coaxial cable comprising the steps of making disks of dielectric material having a conductive layer on opposite faces thereof, providing a plurality of center conductors each surrounded by a sleeve of dielectric material, aligning the center conductors and metallurgically joining the end of each center conductor to a central portion of the conductive layers so that each conductive layer is metallurgically joined to one end of said center conductors, surrounding said disks and the sleeves with a seamless tube of dielectric material contacting the outer periphery of said sleeves and disks, inserting the thusly formed structure into an electrically conductive jacket, and applying compressive forces radially inwardly on the entire circumference of said jacket to reduce the inner diameter of said jacket thereby exerting radially inward compressive forces on the entire circumference of said seamless tube to eliminate any air gap therebetween.

* * * * *